United States Patent [19]

Bauer

[11] 3,967,086

[45] June 29, 1976

[54] ELECTRICAL SWITCH CONSTRUCTION

[75] Inventor: Werner R. Bauer, Radnor, Pa.

[73] Assignee: Robertshaw Controls Company, Richmond, Va.

[22] Filed: Mar. 12, 1975

[21] Appl. No.: 557,462

[52] U.S. Cl. ..... 200/328; 200/325; 337/327

[51] Int. Cl.[2] ..... H01H 9/20

[58] Field of Search ..... 337/91, 327, 130, 155, 337/348, 358, 367; 200/325, 328

[56] References Cited

UNITED STATES PATENTS 2,760,014 8/1956 Euler ..... 200/328

3,392,598 7/1968 Waldorf et al. ..... 200/328

*Primary Examiner*—Harold Broome

*Attorney, Agent, or Firm*—Candor, Candor & Tassone

[57] ABSTRACT

An electrical switch construction having a housing provided with an electrical switch therein. A pair of actuators are carried by the housing and are operatively associated with the electrical switch for operating the electrical switch independently of each other, one of the actuators being automatically reset and the other of the actuators being manually reset by a manually operated reset member carried by the housing and being operatively associated with the other actuator.

10 Claims, 8 Drawing Figures

ELECTRICAL SWITCH CONSTRUCTION

This invention relates to an improved electrical switch construction and to a method for making the same.

It is well known that an electrical switch construction has been provided wherein a movable actuator changes the operative condition of the electrical switch when the movable actuator is moved from one position thereof to another position thereof. Such electrical switch automatically resets itself or requires the operation of a manually operated reset means to reset the same.

It is a feature of this invention to provide an electrical switch construction wherein two actuators are adapted to operate the electrical switch independently of each other with one of the actuators being automatically reset and the other of the actuators being manually reset.

In particular, one embodiment of this invention provides an electrical switch construction having a housing provided with an electrical switch therein. A pair of actuators are carried by the housing and are operatively associated with the electrical switch for operating the electrical switch independently of each other. One of the actuators is adapted to be automatically reset while the other of the actuators must be manually reset by a manually operated reset member that is carried by the housing and is operatively associated therewith.

Accordingly, it is the object of this invention to provide an improved electrical switch construction having one or more of the novel features set forth above or hereinafter shown or described.

Another object of this invention is to provide an improved method of making such an electrical switch construction or the like.

Other objects, uses and advantages of this invention are apparent from a reading of this description which proceeds with reference to the accompanying drawings forming a part thereof and wherein.

Figure 1:
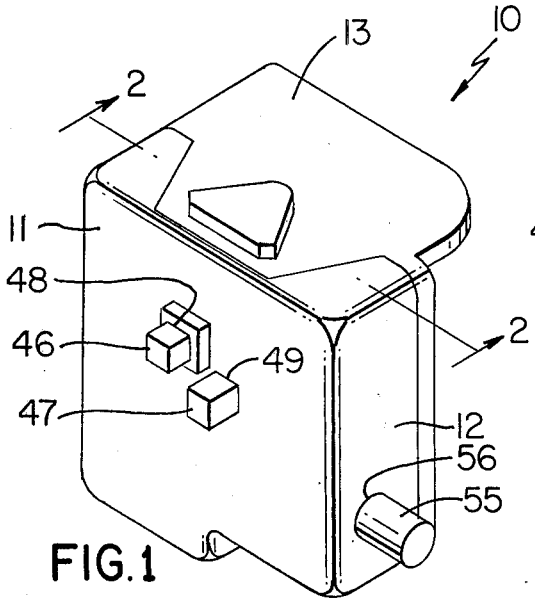
FIG. 1 is a perspective view of the improved electrical switch construction of this invention.
Figure 3:
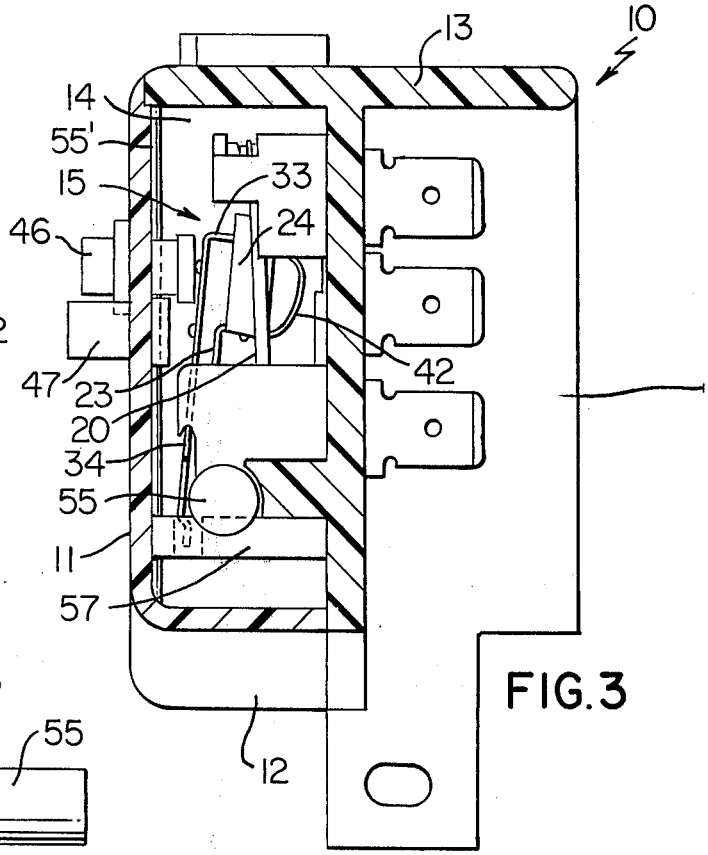
FIG. 3 is a cross-sectional view taken on line 3—3 of FIG. 2.

While the various features of this invention are hereinafter described and illustrated as providing an electrical switch construction that is adapted to be operated by changes in pressure or temperature, it is to be understood that the various features of this invention can be utilized singly or in any combination thereof to provide a switch construction that can be utilized with other actuator movers as desired.

Therefore, this invention is not to be limited to only the embodiment illustrated in the drawings, because the drawings are merely utilized to illustrate one of the wide varieties of uses of this invention.

Figure 5:
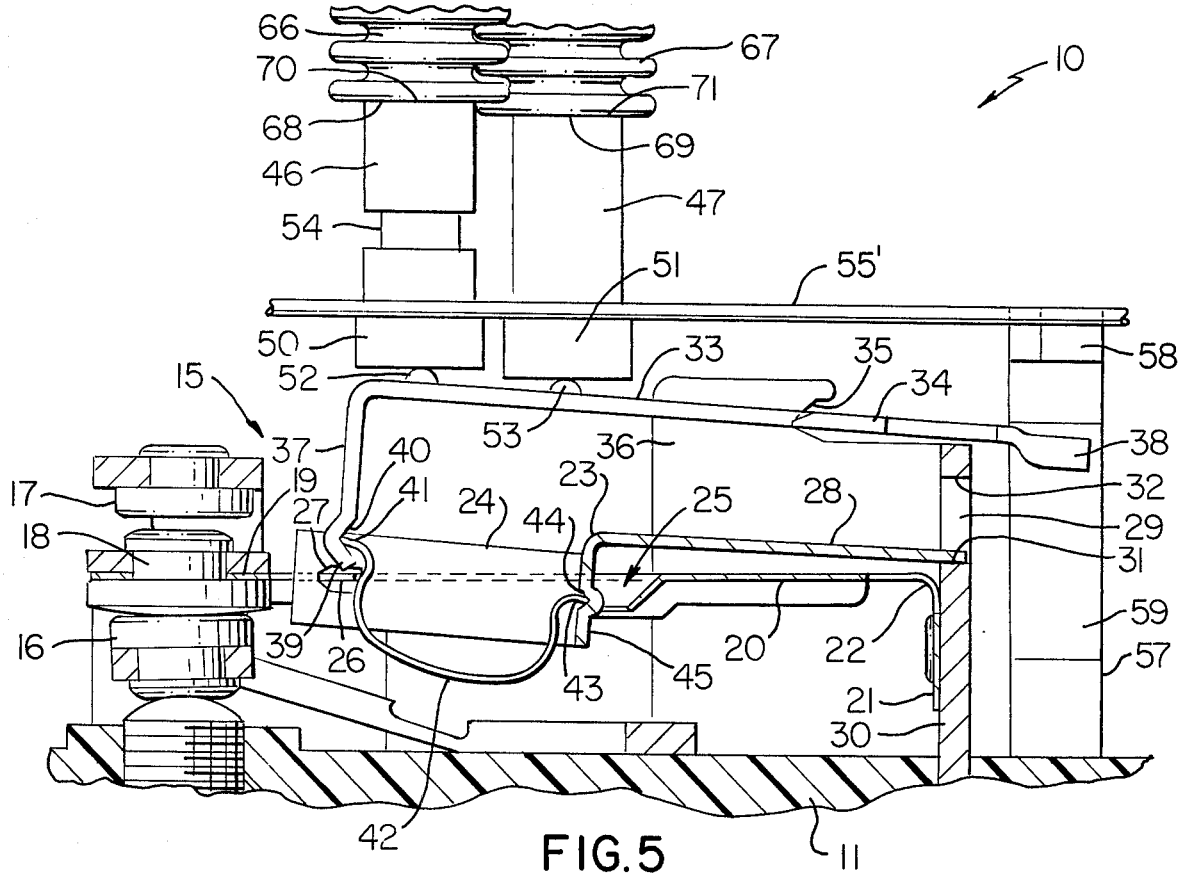
FIG. 5 is an enlarged fragmentary cross-sectional view taken substantially on line 5—5 of FIG. 2 and illustrates the electrical switch construction in the reset condition thereof.

Referring now to FIGS. 1 and 5, the improved electrical switch construction of this invention is generally indicated by the reference numeral 10 and comprises a housing means 11 formed from two housing parts 12 and 13 secured together in such manner that the same define a chamber 14 therein that contains an electrical switch that is generally indicated by the reference numeral 15 in FIG. 5, the electrical switch 15 being a single pole, double throw electrical switch but it is obvious that the same could be a single pole, single throw; double pole, single throw or double pole, double throw as desired without departing from the scope of this invention.

The electrical switch 15 as illustrated in the drawings comprises a pair of fixed contacts 16 and 17 supported by the housing means 11 in a spaced aligned relation and having a movable contact 18 disposed therebetween, the movable contact 18 being carried by the free end 19 of a flexible switchblade 20 having the other end 21 thereof fastened to the housing means 11 whereby the switchblade 20 has a pivot point 22 defined by a right angle bend thereof as illustrated.

A toggle member 23 forms part of the electrical switch 15 and has a pair of spaced apart side members 24 respectively disposed in a substantially rectangular cutout 25 in the switchblade 20 and respectively receiving inwardly directed tangs 26 of the switchblade 20 in slots 27 thereof whereby up and down movement of the slots 27 of the toggle member 23 in a manner hereinafter described will cause the free end 19 of the switchblade to move up and down as will be apparent hereinafter. The toggle member 23 has a rear extension or tang 28 received in a slot 29 of a housing part 30 whereby the tang 28 of the toggle 23 is disposed either against a lower surface 31 that defines the bottom of the slot 29 or against an upper surface 32 thereof that defines the top of the slot 29 in a manner that will be apparent hereinafter.

An actuating lever 33 is pivotally carried in the housing means 11 by having a pair of side tangs 34 thereof respectively received in fulcrum notches 35 of a pair of upstanding ears 36 of the housing part 30 whereby the lever 33 is pivotally mounted intermediate its opposed ends 37 and 38.

Figure 7:
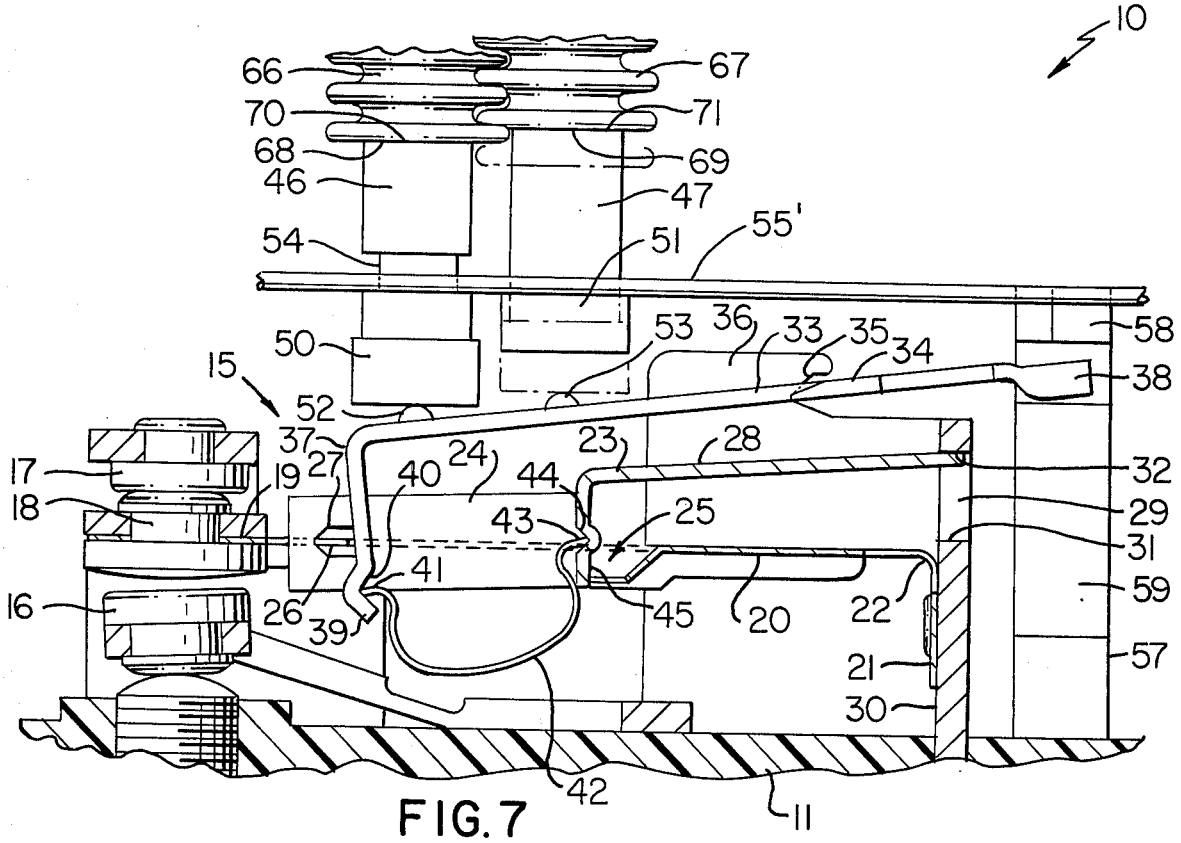
FIG. 7 is a view similar to FIG. 6 and illustrates the electrical switch construction in another operating condition thereof.

The end 37 of the actuating lever 33 is bent at a right angle relative thereto and at the lower end 39 thereof is provided with a notch 40 that receives an outwardly directed end 41 of a C-shaped rolling spring 42 that has its other outwardly directed end 43 received in a similar notch 44 in a cross member 45 of the toggle member 23 in the manner illustrated in FIG. 5 whereby the rolling spring 42 renders the switchblade 20 substantially snap acting between the operating positions of FIGS. 5 and 7 as will be apparent hereinafter.

A pair of axially moveable actuators 46 and 47 project through suitable openings 48 and 49 formed in the cover member 12 of the housing means 11 and have enlarged ends 50 and 51 effectively disposed in the chamber 14 to prevent the same from pulling out of the chamber 14 as well as for abutting against suitable hemispherical parts 52 and 53 of the actuating lever 33 whereby up and down movement of the actuators 46 and 47 independently of each other can cause pivoting movement of the actuating lever 33 to change the operating condition of the switch 15 in a manner hereinafter described.

The actuator 46 has an annular recess 54 therein that is adapted to receive a locking wire spring 55′ carried in the chamber 14 of the housing means 11 to lock the actuator 46 in its "in" position as illustrated in FIG. 7 for a purpose hereinafter described whereby manual reset means must be utilized to unlock the actuator 46 from the actuated position of FIG. 7 as will be apparent hereinafter.

Figure 2:
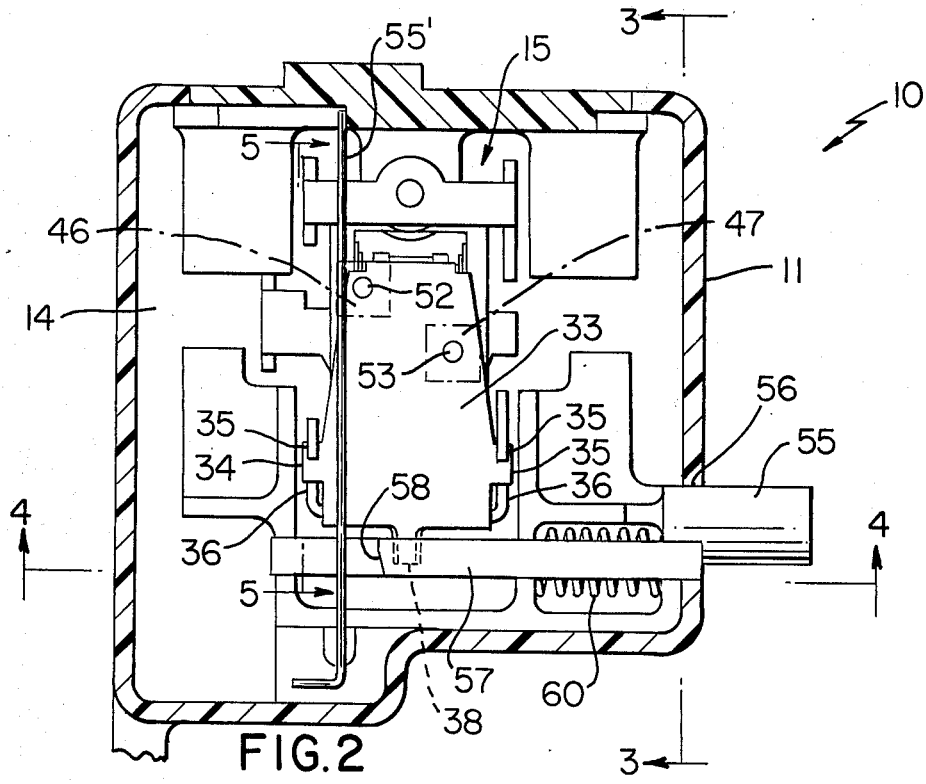
FIG. 2 is an enlarged, cross-sectional view taken on lines 2—2 of FIG. 1.
Figure 8:
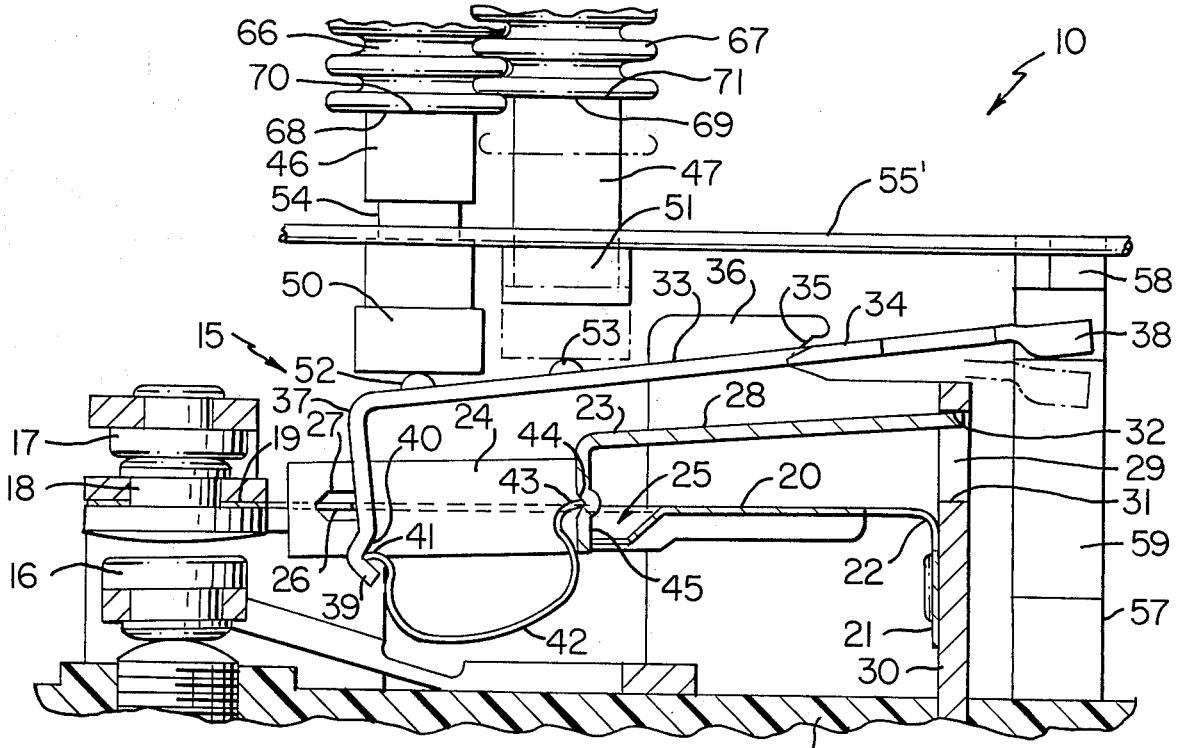
FIG. 8 is a view similar to FIG. 7 and illustrates the resetting action of the manual reset means thereof.

Such manual reset means includes an axially movable plunger 55 carried by the housing means 11 and projecting out through a suitable opening 56 in the cover member 12 as illustrated in FIGS. 1 and 2, the plunger 55 being interconnected to a movable cam member 57 that is axially movable in the chamber 14 of the housing means 11 and has an end tang 58 for engaging against the wire spring 55′ to move the same out of the recess 54 of the actuator 46 when engaged thereagainst in the manner illustrated in FIG. 8 while having a cam surface 59 for operating against the end 38 of the actuating lever 33 for a purpose hereinafter described.

The manual reset member 55 is normally urged to its out and non-resetting position by a compression spring 60 having one end 61 disposed against an internal wall 62 of the housing means 11 while its other end 63 is disposed against a part 64 of the cam portion 57 of the plunger 55 at a cutout 65 thereof as illustrated. Thus, the force of the compression spring 60 normally tends to maintain the manual reset member 55 in the non-resetting position of FIGS. 2 and 4.

From the above description of the electrical switch construction 10 of this invention, it can be seen that the same can be formed of a relatively few parts in a simple and effective manner to operate in a manner now to be described.

The electrical switch construction 10 of this invention is adapted to have each actuator 46 and 47 controlled by any desired device and in the embodiment illustrated in the drawings, a pair of bellows constructions 66 and 67 are respectively illustrated as having the lower movable walls 68 and 69 respectively thereof secured to or abutting against the upper ends 70 and 71 of the actuators 46 and 47.

The bellows construction 66 and 67 can be condition responsive devices, such as being responsive to temperature changes or pressure changes in a manner well known in the art whereby as the particular sensed condition increases for the bellows construction 66, the movable wall 68 thereof tends to move downwardly and as the particular sensed condition thereof decreases, the movable wall 68 tends to move upwardly. Similarly, the movable wall 69 of the bellows construction 67 tends to move downwardly as this particular condition being sensed increases and tends to move upwardly as this particular condition being sensed decreases.

When the particular electrical switch construction 10 is to be utilized, a selection is made as to whether the same is to be operated with the bellows construction 66 or with the bellows construction 67, such decision being based on the fact that if the bellows construction 66 for the actuator 46 is to be utilized, the switch construction 10 must be manually reset by the manually operated reset means 55 and if the bellows construction 67 is to be utilizied, the switch construction will be automatically reset.

Accordingly, assume that the switch construction 10 is to be operated by the bellows construction 66 and the condition being sensed by the bellows construction 66 is such that the same permits the actuator 46 to be disposed in the position illustrated in FIG. 5. With the actuator end 50 of the actuator 46 disposed in the "up" position illustrated in FIG. 5, the natural bias or resulting force of the C-spring 42 is such that the same maintains the switchblade 20 in its down condition so that the movable contact 18 is urged and maintained in good electrical contact with the lower fixed contact 16 as illustrated in FIG. 5.

Figure 4:
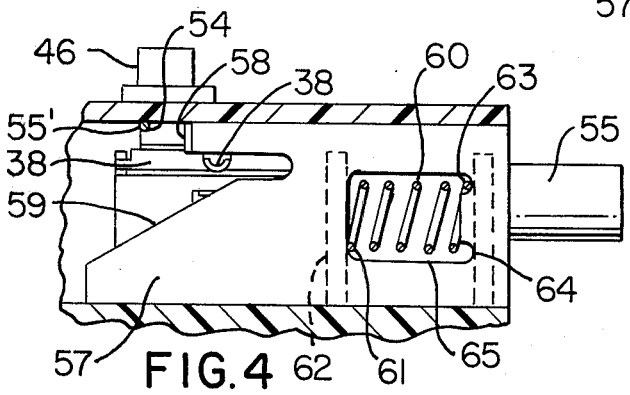
FIG. 4 is a fragmentary cross-sectional view taken on line 4—4 of FIG. 2.
Figure 6:
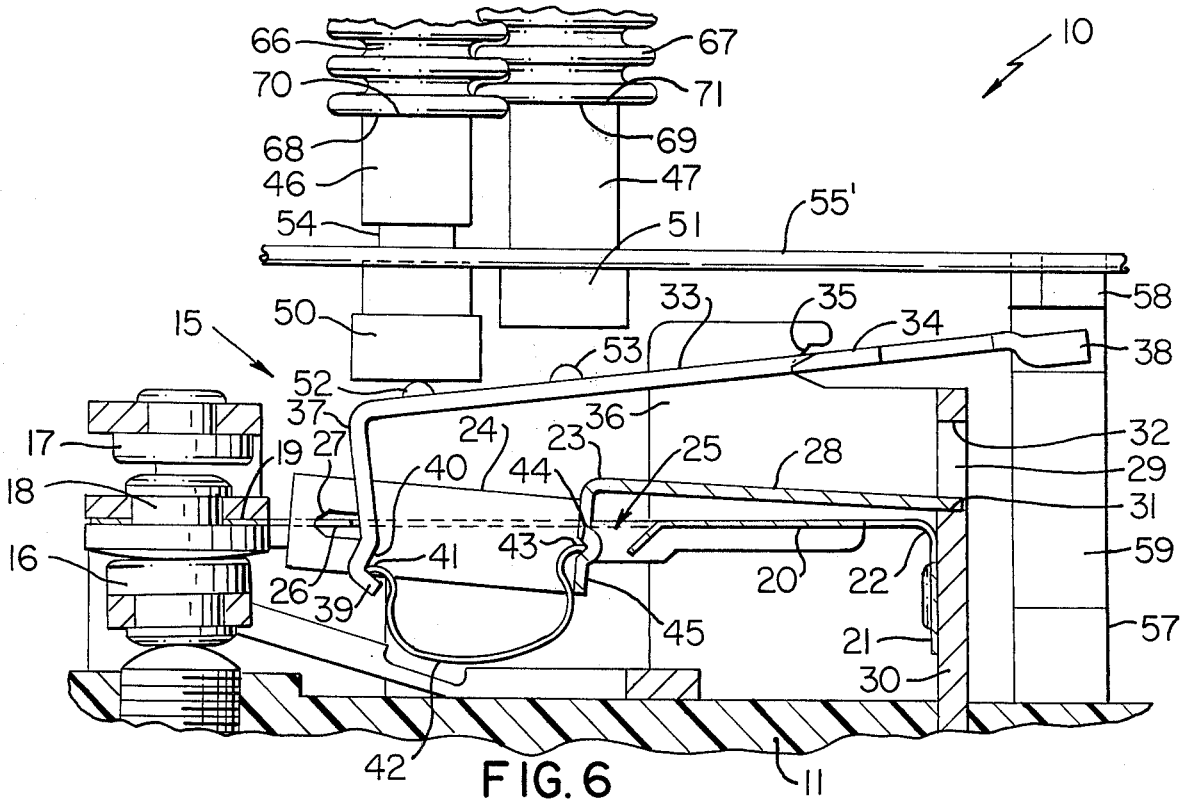
FIG. 6 is a view similar to FIG. 5 and illustrates the electrical switch construction during the operation of one of the actuators thereof.

However, as the condition being sensed by the bellows construction 66 increases, the movable wall 68 thereof tends to move downwardly and carries the actuator 46 therewith whereby the same begins to cause the actuating lever 33 to pivot in a counterclockwise direction from the position illustrated in FIG. 4 all the way down to the position illustrated in FIG. 6 where the electrical switch 15 is just about to begin to snap the movable contact 18 upwardly. This movement of the contact 18 upwardly occurs with a snap action as illustrated in FIG. 7 because once the toggle member 23 is moved over center by the downwardly moving lever 33, the tang 28 of the toggle member 23 moves upwardly from the surface 31 of the housing part 30 to the surface 32 thereof and causes the blade 20 to move over center and be driven upwardly by the C-shaped spring 42 with a snap action in the manner illustrated in FIG. 7 even though the natural bias of the force of the switch 15 is to tend to move the lever 33 upwardly in a clockwise direction.

However, when the actuator 46 has been moved downwardly by the expanding bellows construction 66 through the trip point illustrated in FIG. 7 to cause the movable contact 18 to be snapped upwardly into contact with the fixed contact 17, and, thus, out of contact with the lower fixed contact 16, the annular recess 54 of the actuator 46 has aligned itself with the locking spring 55′ whereby the locking spring 55′ enters the recess 54 through its natural bias and locks the actuator 46 in the actuated position of FIG. 7.

Thus, even should the condition being sensed by the bellows construction 66 now decrease to such a condition that the same would permit the actuating lever 33 to return to the position illustrated in FIG. 5 and cause the switchblade 20 to snap downwardly and place the movable contact 18 again against the fixed contact 16 as illustrated in FIG. 5 through the natural bias of the switch 15, the locking spring 55′ is preventing the switch construction 10 from being so reset by holding the actuator 46 and, thus, the lever 33 in the actuated condition of FIG. 7.

Thus, a person must manually reset the switch construction 10 from the position illustrated in FIG. 7 should the bellows construction 66 be in a position to permit the switch construction 10 to be reset back to its condidtion illustrated in FIG. 5.

Accordingly, to reset the switch construction 10, the operator pushes inwardly on the plunger 55 of the reset means in opposition to the force of the compression spring 60 to move the cam member 57 to the left in FIG. 4 so that the tang end 58 thereof will engage against the locking spring 55′ and move the same out of the annular recess 54 of the actuator 46 to free the same. However, when the spring 55′ is moved out of the recess 54 of the actuator 46, the actuator 46 still will not move upwardly a sufficient distance to permit the actuator 33 to move upwardly to reset the switch construction 10 as the tang end 38 of the lever 33 is held up by the cam surface 59 of the cam part 57 of the reset member 55 so that the reset member 55 must be permitted to move completely outwardly again by the spring 60 before the natural bias of the switch 15 will reset the switch 15 back to the condition illustrated in FIG. 5, such constraining action of the cam surface 59 of the reset member 55 being illustrated in FIG. 8. However, the cam surface 59 of the reset cam 57 does permit the lever 33 to pivot slightly in a clockwise direction and thereby clear the recess 54 of the actuator 46 from the spring 55′ as illustrated when the reset member 55 is in its fully pushed in condition.

Thus, once the reset member 55 is released from its "in" position, the cam surface 59 moves away from the tang end 38 of the actuator lever 33 to permit the same to be rotated in a clockwise direction by the natural bias of the switch 15 to permit the switch 15 to return to the operative condition illustrated in FIG. 5 with a snap action.

Thus, it can be seen that when the bellows construction 66 of the switch construction 10 is utilized, the switch construction 10 becomes a manual reset control.

However, when the bellows construction 67 is utilized, the switch construction 10 becomes an automatic reset control.

In particular, when the bellows construction 67 is utilized, and the same has its end 69 moved downwardly from the position illustrated in FIG. 5 by the bellows construction 67 expanding, the bellows construction 67 moves the actuator 47 downwardly therewith to cause the lever 33 to pivot in a counterclockwise direction until the lever 33 reaches the position illustrated in FIG. 7 whereby the toggle member 33 causes the switchblade 20 to snap over center and move its end 19 upwardly to move the contact 18 into contact with the fixed contact 17 with a snap action in the manner previously described. However, should the bellows construction 67 subsequently begin to collapse and thereby have its end 69 move upwardly, the natural bias of the switch 15 moves the actuator lever 33 in a clockwise direction and thereby moves upwardly with the actuator 47 until the lever 33 reaches substantially the position illustrated in FIG. 5 and causes the toggle member 23 to move its end 28 downwardly and thereby cause the blade 20 to snap downwardly whereby the switch 15 is automatically reset when the bellows construction 67 collapses to the condition illustrated in FIG. 5.

Thus, it can be seen that when the bellows construction 67 is utilized for the switch construction 10, the same renders the control 10 of this invention an automatic reset control.

Of course, it is to be understood that the switch construction 10 could be made with only the actuator 47 or with only the actuator 46 if desired.

Thus, a complete family of controls having the configuration of the control 10 of FIG. 1 could be provided wherein the control could be an automatic reset control or a manual reset control or in the case of a dual unit as illustrated and described, be an automatic and manual reset control. Further, as previously described, each control could be single pole single throw, single pole double throw, double pole single throw, or double pole double throw as desired by merely changing the housing part 13 that contains the terminals for the switch 15 and changing the switchblade 20 as necessary.

Accordingly, it can be seen that this invention not only provides an improved electrical switch construction, but also this invention provides an improved method of making such an electrical switch construction or the like.

While the form and method of this invention now preferred have been described and illustrated as required by the Patent Statute, it has been understood that other forms and method steps can be utilized and still come within the scope of the appended claims.

What is claimed is:

1. An electrical switch construction comprising a housing having a single electrical switch therein provided with only one movable contact, and a pair of actuators carried by said housing and both being operatively associated with said electrical switch for operating said electrical switch independently of each other, one of said actuators being automatically reset and the other of said actuators being manually reset.

2. An electrical switch construction as set forth in claim 1 wherein a manually operated reset member is carried by said housing and is operatively associated with said other actuator to reset the same.

3. An electrical switch construction as set forth in claim 1 wherein said switch has an actuating lever for changing the operative condition of said switch from one condition thereof to another condition thereof when said lever is moved from one position thereof to another position thereof.

4. An electrical switch construction as set forth in claim 3 wherein said actuators engage against said lever and each is adapted to move said lever from said one position thereof to said other position thereof when the respective actuator is moved relative to said housing through a certain distance.

5. An electrical switch construction as set forth in claim 4 wherein said switch has a natural bias to tend to move said lever back from said other position thereof to said one position thereof and thereby again change the operative condition of said switch from said other condition thereof to said one condition thereof.

6. An electrical switch construction as set forth in claim 5 wherein condition responsive means is adapted to be operatively associated with one of said actuators to cause movement thereof through said certain distance to change the operative condition of said switch from said one condition thereof to said other condition thereof when said condition responsive means is sensing a certain condition.

7. An electrical switch construction as set forth in claim 6 wherein said condition responsive means is associated with said one actuator whereby said natural bias of said switch will automatically reset said switch from said other condition thereof back to said one condition thereof when said condition responsive means senses a certain other condition.

8. An electrical switch construction as set forth in claim 6 wherein said condition responsive means is associated with said other actuator, said housing having lock means for locking said other actuator from movement relative to said housing after said other actuator has been moved said certain distance by said condition responsive means whereby the natural bias of said switch can not reset said switch from said other condition thereof back to said one condition thereof when said condition responsive means senses a certain other condition until said lock means is unlocked from said other actuator.

9. An electrical switch construction as set forth in claim 8 wherein a manually operated reset member is carried by said housing and is operatively associated with said lock means to unlock the same from said other actuator when said reset member is operated in a certain manner.

10. An electrical switch construction as set forth in claim 9 wherein said lock means comprises a spring, said other actuator having a recess that receives said spring therein to lock with said other actuator.

* * * * *